US009304487B2

(12) United States Patent
Shuhama et al.

(10) Patent No.: US 9,304,487 B2
(45) Date of Patent: Apr. 5, 2016

(54) IMAGE FORMING APPARATUS AN OPENING/CLOSING MEMBER, A CARTRIDGE SUPPORT MEMBER, AND A LOCK THAT IS RELEASED WHEN CARTRIDGE SUPPORT MEMBER MOVES TO AN OUTER POSITION

(71) Applicant: CANON KABUSHIKI KAISHA, Tokyo (JP)

(72) Inventors: Yu Shuhama, Yokohama (JP); Tomio Noguchi, Suntou (JP); Yuichiro Osawa, Kamakura (JP)

(73) Assignee: Canon Kabushiki Kaisha, Tokyo (JP)

( * ) Notice: Subject to any disclaimer, the term of this patent is extended or adjusted under 35 U.S.C. 154(b) by 168 days.

(21) Appl. No.: 13/901,457

(22) Filed: May 23, 2013

(65) Prior Publication Data

US 2013/0315619 A1 Nov. 28, 2013

(30) Foreign Application Priority Data

May 28, 2012 (JP) ..... 2012-121223

(51) Int. Cl.
*G03G 21/18* (2006.01)
*G03G 15/01* (2006.01)
*G03G 21/16* (2006.01)

(52) U.S. Cl.
CPC ..... *G03G 21/1803* (2013.01); *G03G 15/0189* (2013.01); *G03G 21/1633* (2013.01); *G03G 21/1853* (2013.01); *G03G 2215/0132* (2013.01); *G03G 2221/169* (2013.01); *G03G 2221/1684* (2013.01)

(58) Field of Classification Search
CPC ..... G03G 21/1853; G03G 21/1633; G03G 21/1803; G03G 15/0189
USPC ..... 399/110, 111
See application file for complete search history.

(56) References Cited

U.S. PATENT DOCUMENTS

| | | | | |
|---|---|---|---|---|
| 8,010,014 | B2 | 8/2011 | Noguchi | |
| 2005/0141947 | A1* | 6/2005 | Nishimura | 400/691 |
| 2006/0210306 | A1 | 9/2006 | Okamoto | |
| 2010/0080614 | A1* | 4/2010 | Yamaguchi et al. | 399/111 |

FOREIGN PATENT DOCUMENTS

| | | | |
|---|---|---|---|
| CN | 1636756 | A | 7/2005 |
| CN | 101286035 | A | 10/2008 |
| CN | 102081327 | A | 6/2011 |
| CN | 102346406 | A | 2/2012 |
| JP | 2-226973 | A | 9/1990 |
| JP | 2010-122661 | A | 6/2010 |

* cited by examiner

*Primary Examiner* — Ryan Walsh
*Assistant Examiner* — Philip Marcus T Fadul
(74) *Attorney, Agent, or Firm* — Canon USA, Inc., IP Division

(57) ABSTRACT

An image forming apparatus includes an opening/closing member movably provided in the apparatus main body and configured to take a closing position to close a first opening and a second opening and an opening position to open the first opening and the second opening. The opening/closing member includes a first opening/closing portion configured to close the first opening at the closing position and a second opening/closing portion configured to close the second opening at the closing position and provided so as to be movable with respect to the first opening/closing portion. A cartridge support member moving, at the opening position, in a pull-out direction from an inner position to an outer position causes the second opening/closing portion to move downstream in the pull-out direction.

10 Claims, 8 Drawing Sheets

IMAGE FORMING APPARATUS AN OPENING/CLOSING MEMBER, A CARTRIDGE SUPPORT MEMBER, AND A LOCK THAT IS RELEASED WHEN CARTRIDGE SUPPORT MEMBER MOVES TO AN OUTER POSITION

BACKGROUND OF THE INVENTION

1. Field of the Invention

The present invention relates to an image forming apparatus, for forming an image on a recording medium, to which a cartridge can be detachably attached.

2. Description of the Related Art

An image forming apparatus is configured to form an image on a recording medium by employing an image forming process such as an electrophotographic process, an electrostatic recording process, or a magnetic recording process. The image forming apparatus includes, for example, a copying machine, a printer (a light-emitting diode (LED) printer, a laser beam printer or the like), a facsimile apparatus, and a multifunction peripheral having the functions of the above-mentioned apparatuses. An image is formed on the recording medium by the image forming apparatus. The recording medium includes, for example, paper, an overhead transparency (OHT) sheet, or a label.

The cartridge includes, for example, a process cartridge or a development cartridge, and contributes to an image forming process for forming an image on a recording medium while being detachably attached to the apparatus main body of the image forming apparatus. The apparatus main body refers to the components of the image forming apparatus excluding the cartridge.

The process cartridge is formed by integrating an image bearing member, on which a latent image is to be formed, with at least one of the following units: a charging unit, a developing unit, a cleaning unit, etc., and is detachably attached to the apparatus main body. The image bearing member includes an electrophotographic photosensitive member for an electrophotographic process, an electrostatic recording dielectric for an electrostatic recording process, a magnetic recording magnetic member for a magnetic recording process or the like. The process cartridge can be attached and detached to and from the apparatus main body manually by the user. Thus, the maintenance of the apparatus main body is easy to perform.

Accordingly, the process cartridge includes a cartridge in which an image bearing member is integrated with a process unit, and is detachably attached to an apparatus main body. The process cartridge in which the image bearing member and the developing unit are integrated is referred to as an integrated-type process cartridge. The process cartridge in which the image bearing member and a process unit excluding the developing unit is integrated is referred to as a separated-type process cartridge. That is, the separated-type process cartridge refers to a cartridge which performs image formation along with the development unit, which is provided separately from the process cartridge.

The development cartridge includes a developing roller (developer bearing member) and contains developer (toner) used for developing a latent image formed on the image bearing member. The development cartridge is detachably attached to the apparatus main body. The development cartridge can also be attached and detached to and from the apparatus main body manually by the user. Thus, the maintenance of the apparatus main body is easy to perform.

In the case of the development cartridge, the image bearing member is mounted to the apparatus main body or a cartridge support member. Alternatively, the image bearing member is provided in the separated-type process cartridge (In this case, the process cartridge does not include the developing unit).

Thus, the cartridge includes the integrated-type or the separated-type process cartridge. Further, the case is included where the separated-type process cartridge and the development cartridge are used together in pairs. Further, the case is included where the image bearing member is fixedly mounted to the apparatus main body or the cartridge support member, with the development cartridge being detachable so as to be capable of acting on the image bearing member. Further, the cartridge also includes a developer cartridge containing developer (toner) to be supplied to the process cartridge, the development cartridge, etc.

For the sake of convenience in illustration, an electrophotographic image forming apparatus employing electrophotography such as a printer will be used as an example for description. An electrophotographic photosensitive member serving as the image bearing member is uniformly charged, and a latent image is formed through selective exposure of the electrophotographic photosensitive member. The latent image is developed with the developer to be visualized as a developer image, and then the image is transferred to a recording medium. By applying heat and pressure to the transferred developer image, the image is fixed and recorded onto the recording image.

Such an electrophotographic image forming apparatus involves the supply of developer and the maintenance of various process units. As a means for facilitating the developer supply operation and the maintenance, all or part of the electrophotographic photosensitive member, the charging unit, the developing unit, the cleaning unit, etc., are integrated into a frame as a cartridge. There is adopted a cartridge system in which the cartridge is detachably attached to the apparatus main body of the electrophotographic image forming apparatus.

In this cartridge system, the maintenance of the apparatus can be performed by the user in such a way as to replace the cartridge, thereby achieving a substantial improvement in terms of operability. Thus, this cartridge system is widely used in electrophotographic image forming apparatuses.

In this connection, there is provided a description of an electrophotographic image forming apparatus in which a plurality of cartridges are arranged in a substantially horizontal direction. To facilitate the attachment and detachment of the cartridge with respect to this electrophotographic image forming apparatus, there has been proposed a pull-out configuration in which a plurality of cartridges are integrally pulled out (as discussed in Japanese Patent Application Laid-Open No. 2010-122661). Further, Japanese Patent Application Laid-Open No. 2010-122661 discusses a configuration for achieving a reduction in size of the apparatus main body and securing the replaceability of the cartridge. That is, when a pull-out member is pulled out, the front edge position thereof is situated on the inner side of the front edge position of an opening/closing member. Further, for the attachment and detachment of the cartridge on the upstream side in the pull-out direction supported by the pull-out member, an opening is provided vertically above the apparatus main body. The opening/closing member has a surface curved in an arcuate shape so that, when closed, the opening/closing member can cover an opening provided in the horizontal direction and the opening provided in the vertical direction.

The present invention further improves the above-described conventional technique.

In the related-art configuration, as illustrated in FIG. 2 of Japanese Patent Application Laid-Open No. 2010-122661, when the opening/closing member is opened, the opening/closing member enters the pull-out region of the sheet feeding cassette. That is, when a cassette accommodating sheets having a length larger than that of the apparatus main body (such as A3 size sheets or legal size sheets) is mounted, the cassette will interfere with the opening/closing member. Further, when an attempt is made to further reduce the size in the vertical direction of the image forming apparatus, there is the possibility of interference between the installation surface of the image forming apparatus and the opening/closing member. That is, to solve these problems, it is necessary to diminish the opening provided vertically above the apparatus main body, and to increase the pull-out amount so that the cartridge on the upstream side in the pull-out direction supported by the pull-out member can be attached and detached.

SUMMARY OF THE INVENTION

The present invention is directed to an image forming apparatus in which a reduction in size is achieved while securing replaceability of a cartridge with respect to a cartridge support member.

According to an aspect of the present invention, an image forming apparatus configured to form an image on a recording medium includes a cartridge support member configured to be movable between an outer position where a plurality of cartridges is allowed to be attached to and detached from the cartridge support member on an outer side of an apparatus main body of the image forming apparatus and an inner position where the plurality of cartridges is supported by the cartridge support member to enable image formation inside the apparatus main body; a first opening through which the cartridge support member passes when the cartridge support member moves between the inner position and the outer position; a second opening through which a portion of the plurality of cartridges passes when the plurality of cartridges is attached to or detached from the cartridge support member and which is provided vertically above the cartridge support member; and an opening/closing member movably provided in the apparatus main body and configured to take a closing position to close the first opening and the second opening and an opening position to open the first opening and the second opening, the opening/closing member including a first opening/closing portion configured to close the first opening at the closing position and a second opening/closing portion configured to close the second opening at the closing position and provided so as to be movable with respect to the first opening/closing portion, wherein the cartridge support member moving, at the opening position, in a pull-out direction from the inner position to the outer position causes the second opening/closing portion to move downstream in the pull-out direction.

Further features of the present invention will become apparent from the following description of embodiments (with reference to the attached drawings).

DESCRIPTION OF THE EMBODIMENTS

Various embodiments, features, and aspects of the invention will be described in detail below with reference to the drawings.

An electrophotographic image forming apparatus (hereinafter referred to as the image forming apparatus) 100 will be described. Here, a color laser beam printer is illustrated as the image forming apparatus 100 as an example. The overall configuration and the function of the laser beam printer will be described. The image forming apparatus 100 is applicable not only to a full color laser beam printer but also to some other image forming apparatuses such as a color electrophotographic copying machine or a facsimile apparatus.

[Outline of the Image Forming Apparatus]

Figure 1:
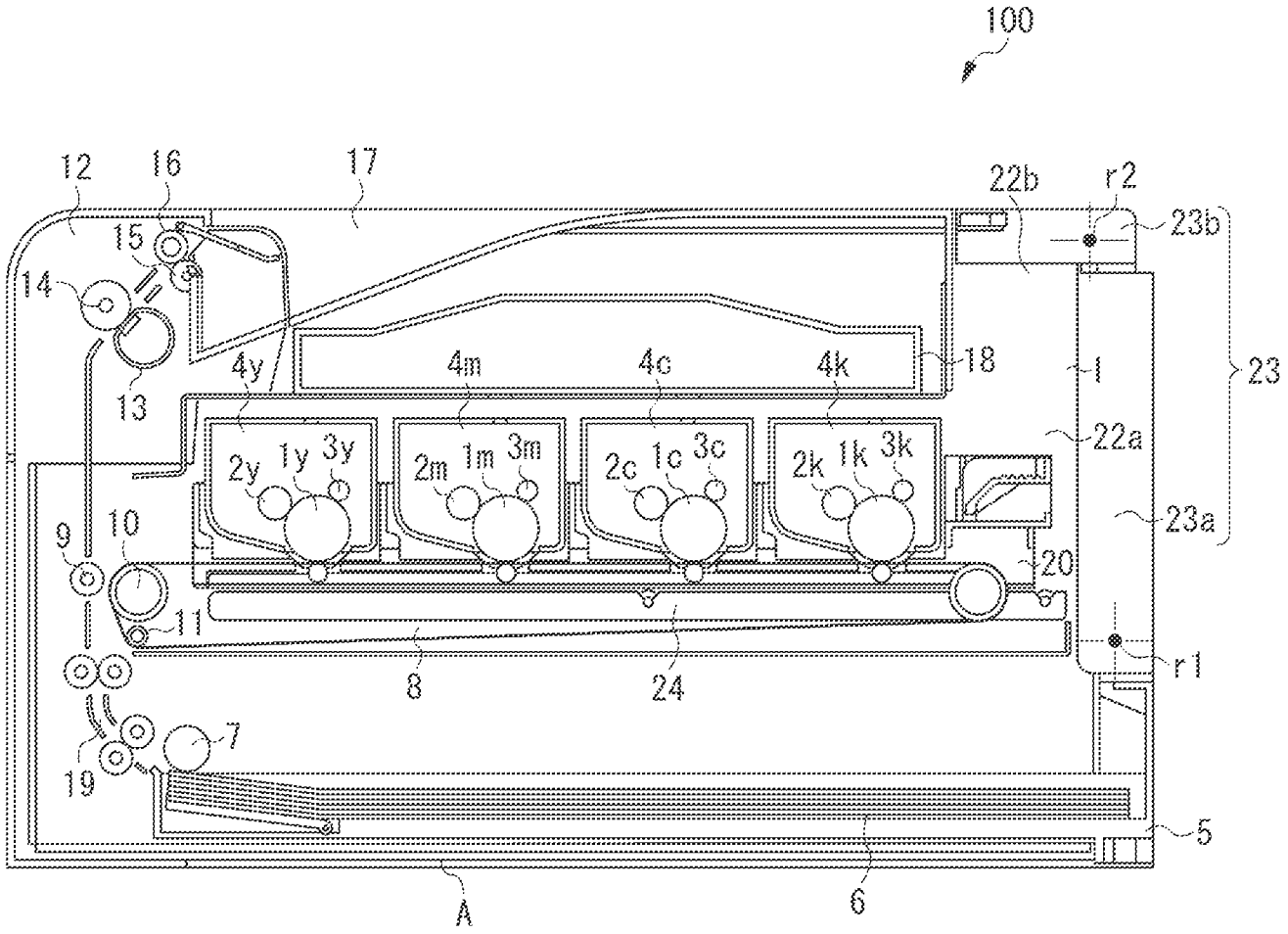
FIG. 1 is a schematic sectional view of an image forming apparatus according to a first embodiment of the present invention (with a cartridge support member at an inner position).

First, the configuration of the image forming apparatus 100 will be described with reference to FIGS. 1 and 2. FIG. 1 is a sectional view of the image forming apparatus 100 according to the first embodiment. In the following description, the front side of an apparatus main body A (the front side of the main body) is the side where there is provided a door member 23, which is an opening/closing member provided to be openable and closable with respect to the apparatus main body A (the right-hand side in FIG. 1). The door member 23 moves between a closing position (illustrated in FIG. 1) covering an opening 22, which includes a first opening 22*a* and a second opening 22*b* provided in the apparatus main body A, and an opening position (illustrated in FIG. 2) opening the opening 22. A tray 20 passes through the opening 22 when the tray 20 moves between an inner position I (illustrated in FIG. 1) and an outer position O (illustrated in FIG. 2).

The back side of the apparatus main body A (the rear side of the main body) is the side opposite the side where the door member 23 is provided and is the side where there is provided a feeding path 19 for a recording medium 6 (the left-hand side in FIG. 1). The apparatus main body A refers to the portion excluding, from the image forming apparatus 100, a tray 20 constituting the cartridge support member and process cartridges 4 (4*y*, 4*m*, 4*c*, and 4*k*).

Provided inside the apparatus main body A are a sheet feeding cassette 5 for accommodating sheets 6 serving as the recording media, a sheet feeding roller 7, an intermediate transfer belt 8, a fixing film 13 and a pressing roller 14 that are provided in a fixing unit 12, a laser scanner 18, etc. Further, provided in the apparatus main body A is the tray 20 which is provided to be movable between the inner position I and the outer position O of the apparatus main body A with respect to the apparatus main body A, and which detachably supports the process cartridges 4 (4*y*, 4*m*, 4*c*, and 4*k*). The cartridges 4 integrally include photosensitive drums 1 (1*y*, 1*m*, 1*c*, and 1*k*), developing rollers 2 (2*y*, 2*m*, 2*c*, and 2*k*) as process units acting on the photosensitive drums 1, charging rollers 3 (3*y*, 3*m*, 3*c*, and 3*k*), and cleaning blades (not illustrated). The cartridges 4 are detachably attached to the tray 20, and are attached to inner positions inside the apparatus main body A where image formation is possible.

The sheets 6 stacked in the sheet feeding cassette 5 are fed by a sheet feeding roller 7 (illustrated in FIG. 1) configured to rotate clockwise, and are sent to a nip portion between a belt drive roller 10 and a transfer roller 9 (transfer portion). The photosensitive drums 1 (illustrated in FIG. 1) start to rotate counterclockwise, and are charged on the outer peripheral surfaces thereof by the charging rollers 3. A laser beam emitted from a laser scanner 18 is applied to the charged photosensitive drums 1 in accordance with image information. As a result, electrostatic latent images are successively formed on the photosensitive drums 1. Subsequently, the electrostatic latent images are developed with developer by the developing roller 2. As a result, developer images are formed on the outer peripheral surfaces of the photosensitive drums 1. Each of the cartridges 4 is of the same configuration, except that the color of developer differs for each cartridge and that the tank volume may differ for each cartridge. The cartridge 4*y* contains yellow developer, and forms a yellow developer image on the photosensitive drum 1*y*. The cartridge 4*m* contains magenta developer, and forms a magenta developer image on the photosensitive drum 1*m*. The cartridge 4*c* contains cyan developer, and forms a cyan developer image on the photosensitive drum 1*c*. The cartridge 4*k* contains black developer, and forms a black developer image on the photosensitive drum 1*k*.

The developer images formed on the photosensitive drums 1 are transferred to an intermediate transfer belt 8. When forming a color image, the yellow, magenta, cyan, and black developer images formed on the photosensitive drums 1 are primarily transferred to the transfer belt 8 while being successively superimposed one upon the other. The intermediate transfer belt 8 is an endless belt configured to rotate while being in contact with the photosensitive drums 1. The intermediate transfer belt 8 is suspended by the belt drive roller 10 and a tension roller 11. The developer images transferred to the intermediate transfer belt 8 are secondarily transferred to a sheet 6 sent to the nip portion between the belt drive roller 10 and the transfer roller 9.

The sheet 6 to which the developer images have been transferred is sent to the nip portion between a fixing film 13 and a pressure roller 14 to undergo heating and pressurization. As a result, the developer images are fixed onto the sheet 6. When forming a monochrome image on the sheet 6, a black developer image is only formed on the photosensitive drum 1*k*, and is transferred to the sheet 6.

The sheet 6 on which the developer images have been fixed is discharged by a discharge roller 15 and a discharge runner 16 to a sheet discharge unit 17.

[Description of a Process Cartridge Replacement System]

Figure 2:
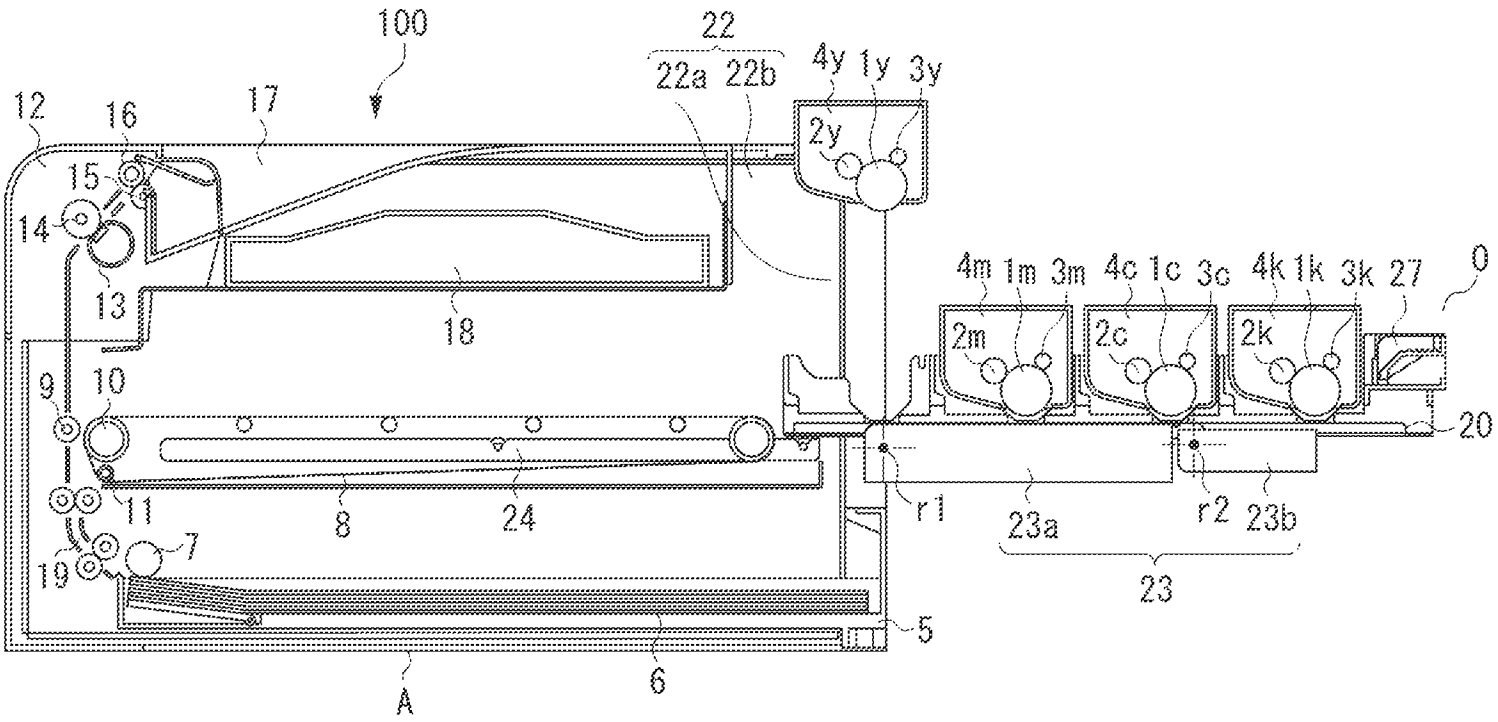
FIG. 2 is a schematic sectional view of the image forming apparatus (with the cartridge support member at an outer position).

The tray 20 supported by a tray support member 24 is provided so as to be slidable, substantially in the horizontal direction through the opening 22, between the inner position I situated on the inner side of the apparatus main body A illustrated in FIG. 1 and the outer position O situated on the outer side of the apparatus main body A illustrated in FIG. 2. Here, the inner position I is the position at which the tray 20 is situated inside the apparatus main body A, that is, on the inner side of the door when the door member 23 is closed. The outer position O is the position at which the tray 20 is situated outside the apparatus main body A, that is, on the outer side of the opening 22. The user pulls out the tray 20 to the outer position O to perform the attachment/detachment and replacement of the cartridges 4 on the tray 20.

[Description of the Cartridge Replacement Procedures]

The door member 23 opens and closes the opening 22 including the first opening 22*a* opening in the horizontal direction of the apparatus main body A and the second opening 22*b* opening in the vertical direction thereof. That is, the door member 23 includes a first opening/closing portion 23*a* for closing the first opening 22*a* and a second opening/closing portion 23*b* for closing the second opening 22*b*.

Figure 6A:
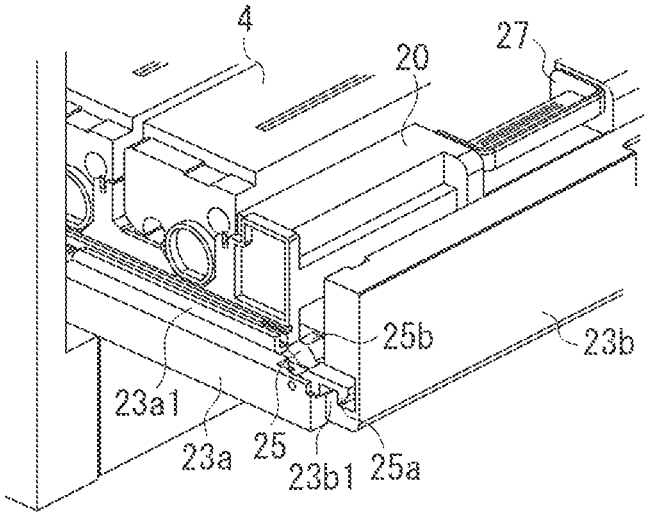
FIG. 6A is a perspective view of a second opening/closing portion in a locked state.
Figure 6B:
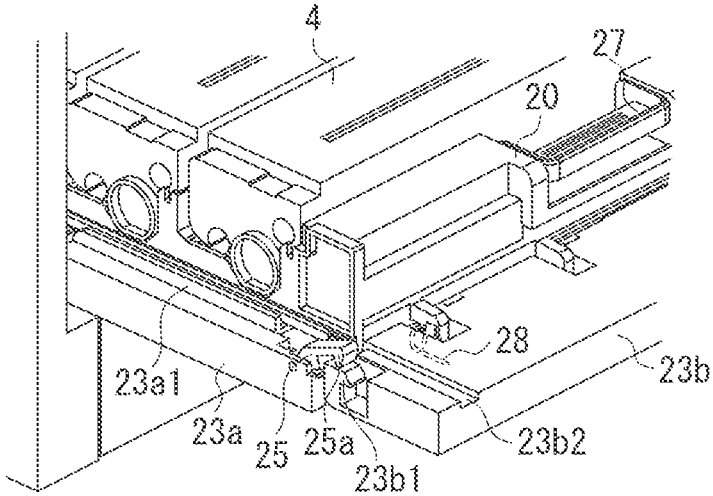
FIG. 6B is a perspective view of the second opening/closing portion in an unlocked state.

The first opening/closing portion 23*a* includes a rotation center r1 on the lower side of the apparatus main body A, and is rotatably mounted to the apparatus main body A. The second opening/closing portion 23*b* has, when the door member 23 is closed, a rotation center r2 on the upper side of the first opening/closing portion 23*a* in a closed state, and is rotatably mounted to the apparatus main body A. An elastic member 28 (as shown in FIG. 6B) is mounted to the first opening/closing member 23*a* and to the rotation center r2 portion of the second opening/closing portion 23*b*. Due to the elastic member 28, the second opening/closing portion 23*b* is biased with respect to the first/opening closing portion 23*a* so as to bias the second opening/closing portion 23*b* towards a protruding position (explained below) with respect to the first opening/closing portion 23*a* (upstream in the pull-out direction of the tray 20 in FIG. 3). Further, a lock member 25 illustrated in FIG. 6 is provided on the first opening/closing portion 23*a*. And, the lock member 25 is engaged with an engaged portion 23*b*1 of the second opening/closing portion 23*b* such that the second opening/closing portion 23*b* is retained in the protruding position at which the second opening/closing portion 23*b* protrudes into the movement path when the tray 20 is pulled out as illustrated in FIG. 6A. When the door member 23 is situated at the closed position (illustrated in FIG. 1), this protruding position is the position where the second opening/closing portion 23*b* closes the second opening 22*b*. Thus, when the user opens the door member 23, the door member 23 is opened with the second opening/closing portion 23*b* being situated at the protruding position as illustrated in FIG. 3.

Figure 3:
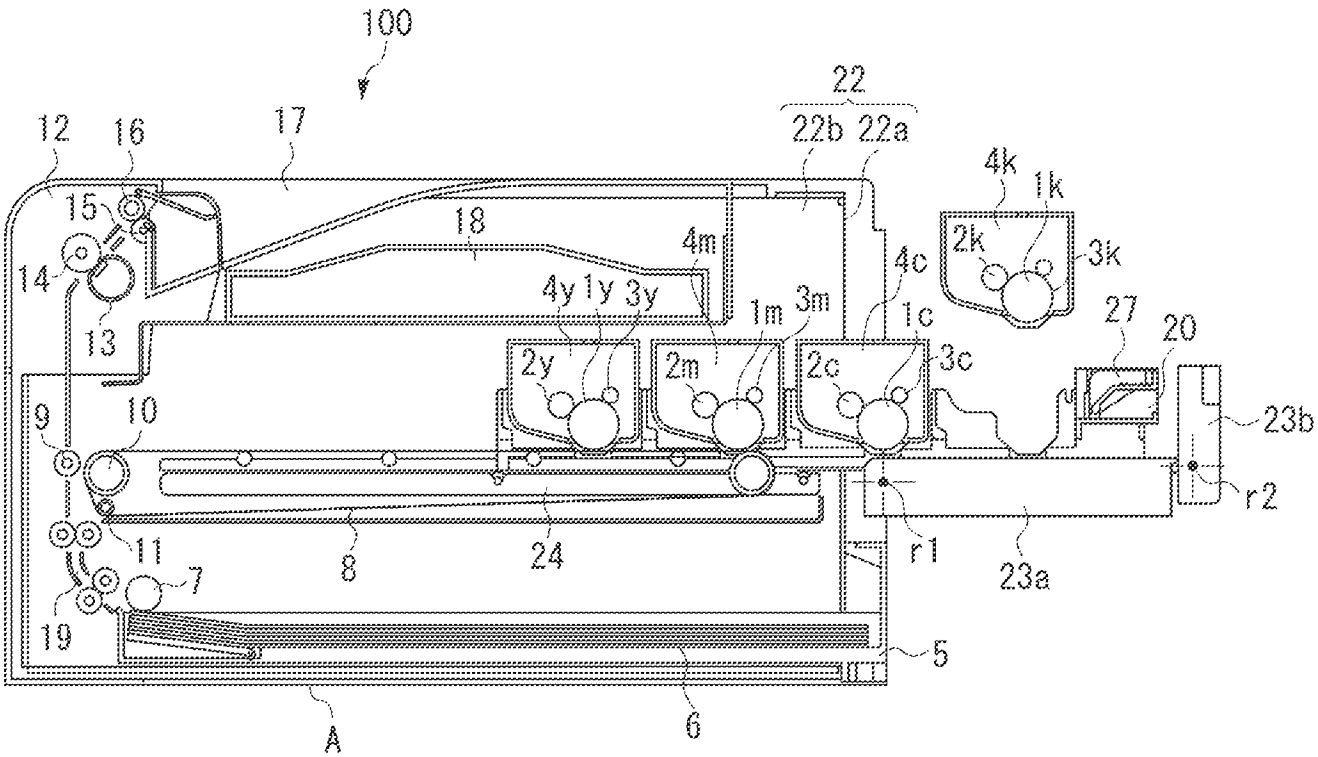
FIG. 3 is a schematic sectional view of the image forming apparatus (with the cartridge support member being pulled out to the outer position).
Figure 4:
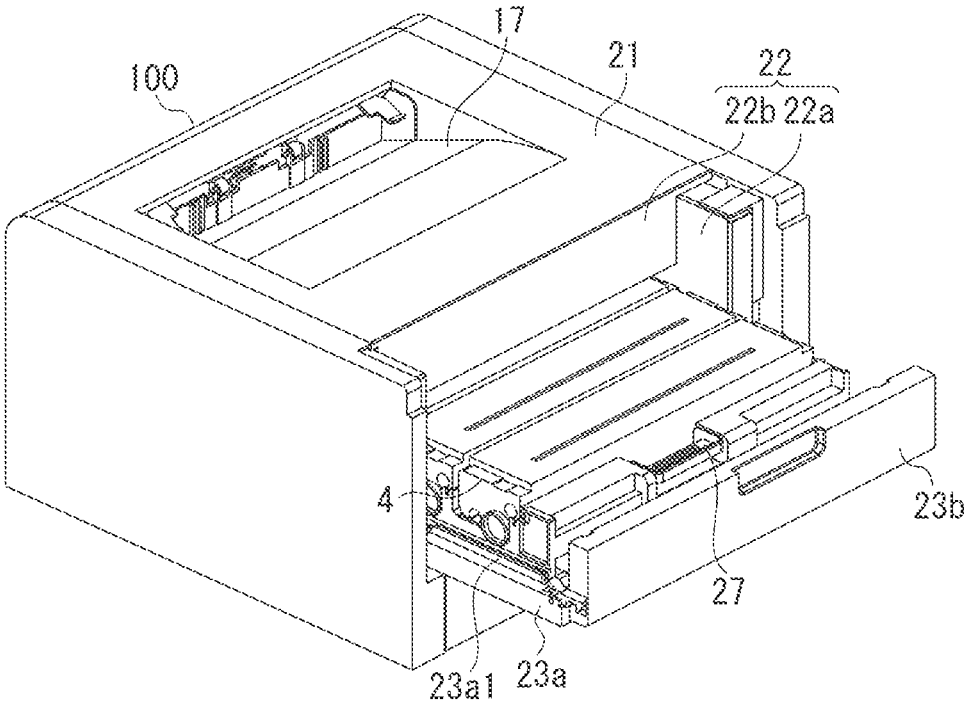
FIG. 4 is a perspective view of the image forming apparatus (with the cartridge support member being pulled out to the outer position).
Figure 7:
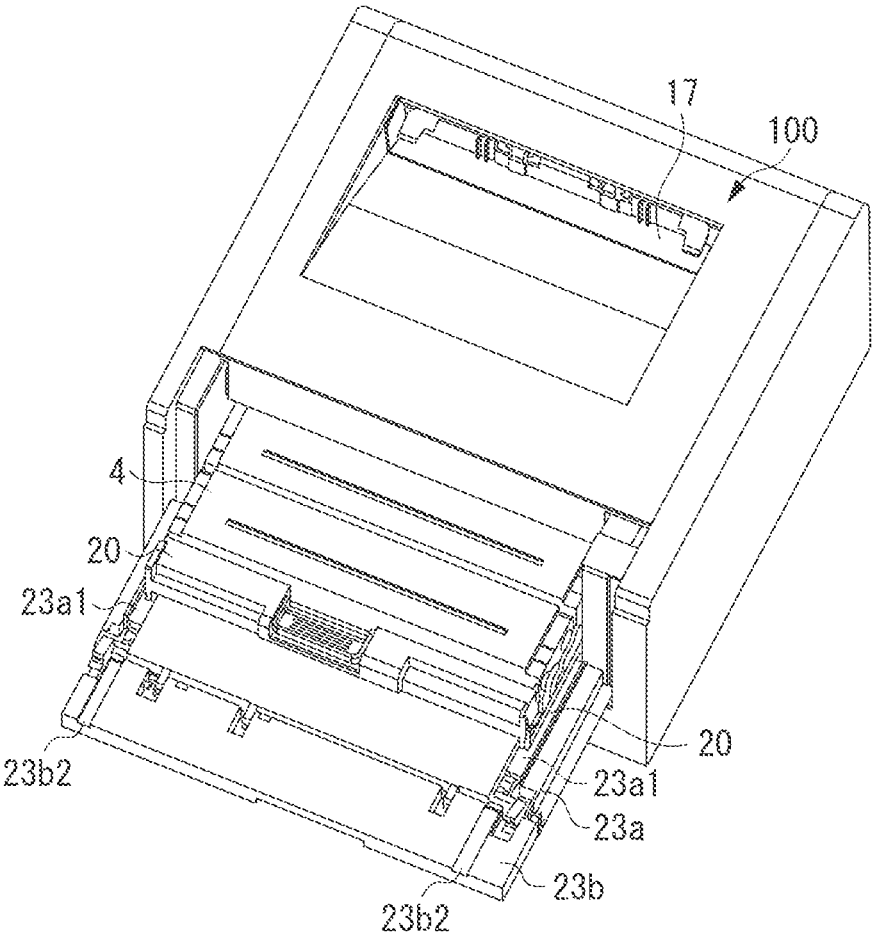
FIG. 7 illustrates a guide rail on a back side of a door member.

Then, the door member 23 is opened, and the user grips a tray grip portion 27 to pull out the tray 20 as illustrated in FIG. 3. The user pulls the tray 20 forwards with respect to the apparatus main body A. Then, the tray 20 slides to the front side of the apparatus main body A from the tray support member 24 of the apparatus main body A along a first guide rail 23*a*1 (see FIG. 7) which is a first guide portion provided on the back side of the first opening/closing portion 23*a* and configured to guide the tray 20, and comes into contact with the second opening/closing portion 23*b* (see FIG. 3). The cartridge 4 on the downstream side in the pull-out direction is the black toner cartridge 4*k*, which is one of the plurality of cartridges 4 and whose replacement frequency is generally high. The attachment/detachment of the black cartridge 4*k* can be performed in this state. As illustrated in FIG. 3, in the present embodiment, it is also possible to attach and detach the cyan cartridge 4*c*. Further, depending on the size of the first opening/closing portion 23*a*, it is also possible to replace the magenta cartridge 4*m*. This position is referred to as the second outer position of the tray 20.

Figure 5:
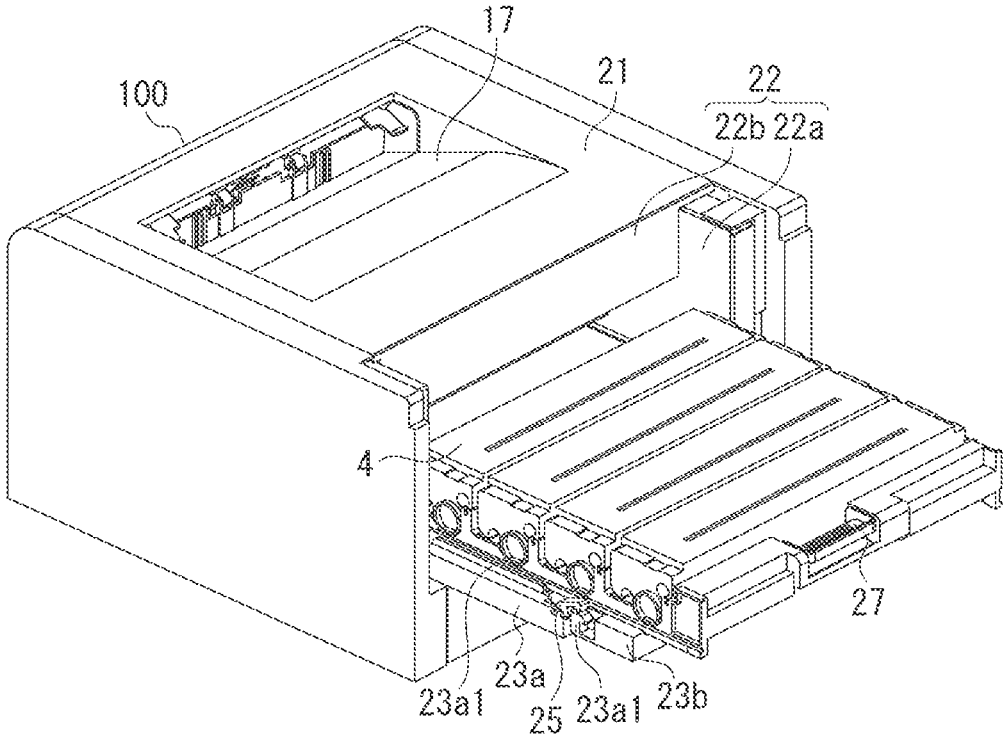
FIG. 5 is a perspective view of the image forming apparatus (with the cartridge support member at the outer position).

To replace the cartridge 4*y* supported at the most upstream side in the pull-out direction of the tray 20, the tray 20 is further pulled out forwards. By pulling out the tray 20, an abutment portion 25*b* of the lock member 25 provided at the first guide rail portion 23*a*1 of the first opening/closing portion 23*a* abuts the tray 20 to rotate the lock member 25. Then, the engagement portion 25*a* of the lock member 25 is separated from the engaged portion 23*a*1 of the first opening/closing portion 23*a* to release the engagement. Through the operation of further pulling out the tray 20, the second opening/closing portion 23*b* is retracted from the protruding position as illustrated in FIG. 6B, and moves to the retracted position, where the movement path for the tray 20 is open. When the second opening/closing portion 23*b* moves to the retracted position, a second guide rail 23*b*2, which is a second guide portion provided on the back side of the second opening/closing portion 23*b*, and the first guide rail 23*a*1 on the back side of the first opening/closing portion 23*a*, extend in a straight line in the pull-out direction of the tray 20. It becomes possible to move the tray 20 to the outer position O, where all the cartridges 4 can be attached and detached. At the outer position O, the user performs the attachment/detachment and replacement of the cartridges 4. As illustrated in the perspective view in FIG. 5, the first opening 22*a* and the second opening 22*b* of the opening 22 of the apparatus main body A are open in the lower-right apparatus main body A in FIG. 5. Thus, at the outer position O, the user can visually check all the cartridges 4 supported by the tray 20, which helps to facilitate the attachment and detachment of the tray 20. This position is referred to as the first outer position of the tray 20. Further, due to the guide rails 23*a*1 and 23*b*2, the tray 20 is regulated in the vertical direction and in the horizontal direction, thereby suppressing unnecessary movement of the tray 20 at the time of attachment/detachment of the cartridges 4. This can improve usability.

When the tray 20 is pushed back to the apparatus main body A after the replacement of the cartridges 4, the tray 20 disappears on the second guide rail 23*b*2 of the second opening/closing portion 23*b*. Then, the second opening/closing portion 23*b* is urged by the elastic member 28 including a spring or the like to move towards the protruding position, whereby the engagement portion 25*a* of the lock member 25 is engaged with the engaged position 23*b*1 of the second opening/closing portion 23*b*, and the second opening/closing portion 23*b* is locked at the protruding position with respect to the first opening/closing portion 23*a*.

As a result, after the replacement of the cartridges 4, the user moves the tray 20 to the inner position of the apparatus main body A, and, by only closing the door member 23 in the state in which the first opening/closing portion 23*a* and the second opening/closing portion 23*b* are integrated, the operation of attaching the tray 20 is completed.

Figure 8:
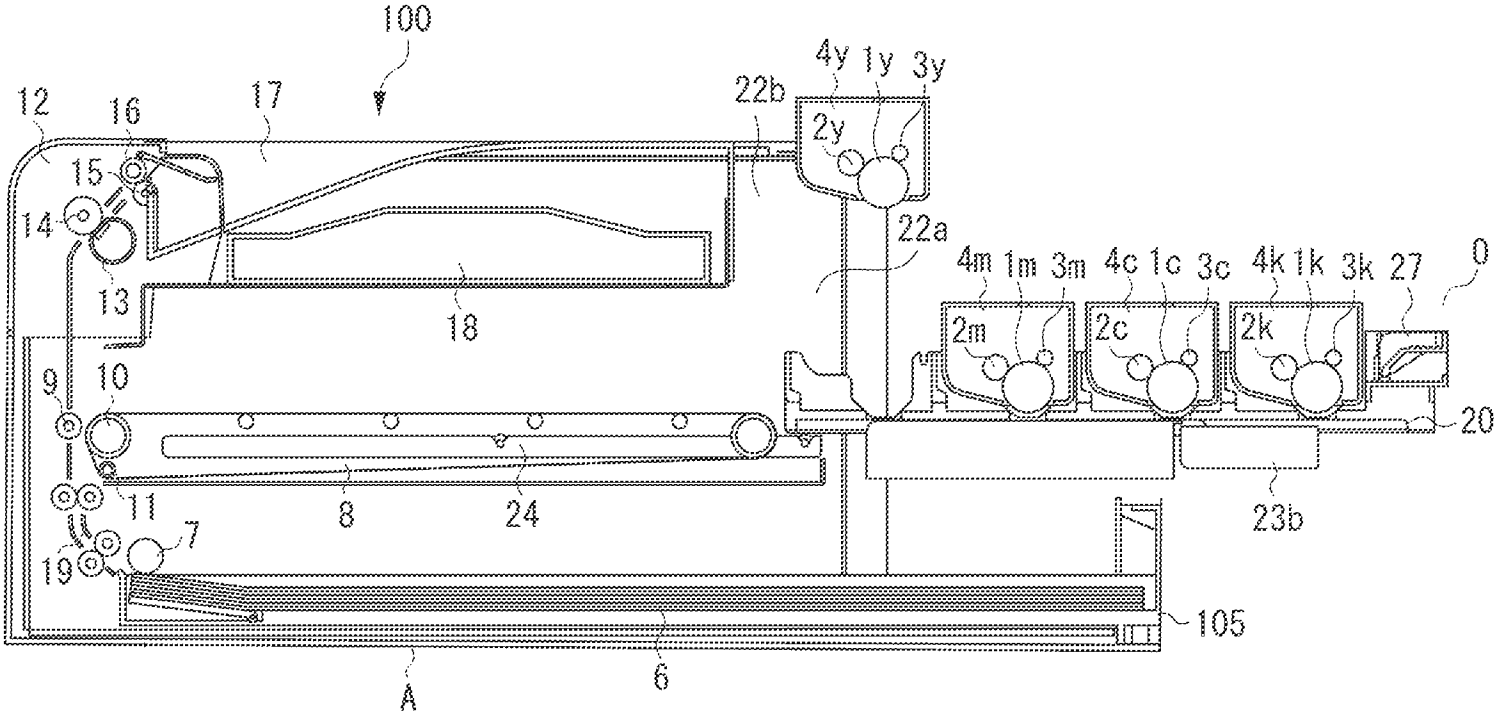
FIG. 8 is a schematic sectional view of the image forming apparatus (with the cartridge support member at the outer position).

As described above, according to the present embodiment, the amount of pulling out of the tray 20 can be reduced while securing the replaceability of the cartridges 4 provided on the upstream side of the second opening 22*b*, which is open vertically above the apparatus main body A, in the pull-out direction of the tray 20. Further, by providing the second opening/closing portion 23*b* to be movable with respect the first opening/closing portion 23*a*, there is no need to greatly open the door member 23 in order to open the movement path of the tray 20. Accordingly, the size in the vertical direction (height) of the image forming apparatus 100 can be diminished. Further, as illustrated in FIG. 8, even in the case where a cassette for large size sheets is attached to the apparatus main body A, the door member 23 does not interfere with the cassette at the opening position.

In the present embodiment described above, the tray 20 is pulled out substantially in parallel to the main body. However, the same effect can also be achieved in a configuration in which the tray is pulled out from the apparatus main body obliquely downwards or obliquely upwards with respect to the horizontal direction (i.e. at an angle with respect to the horizontal plane of the main body).

As described above, according to an embodiment of the present invention, a reduction in size of an image forming apparatus can be achieved while securing cartridge replaceability with respect to the cartridge support member.

While the present invention has been described with reference to embodiments, it is to be understood that the invention is not limited to the disclosed exemplary embodiments.

This application claims the benefit of Japanese Patent Application No. 2012-121223, filed May 28, 2012, which is hereby incorporated by reference herein in its entirety.

What is claimed is:

1. An image forming apparatus configured to form an image on a recording medium, the image forming apparatus comprising:

a cartridge support member configured to move between an outer position where a plurality of cartridges are detachably mountable to the cartridge support member, outside of the main body of the image forming apparatus and an inner position where the plurality of cartridges are supported by the cartridge support member for enabling image formation, inside the body of the image forming apparatus;

a first opening of the main body of the image forming apparatus configured to allow the cartridge support member to pass through the first opening when the cartridge support member is moved between the inner position and the outer position;

a second opening of the main body of the image forming apparatus provided vertically above the cartridge support member and configured so that at least one of the plurality of cartridges can pass through the second opening to attach or detach any of the plurality of cartridges from the cartridge support member;

an opening/closing member movably mounted to the main body of the image forming apparatus and configured to take a closed position that covers the first opening and the second opening and an open position in which the first opening and the second opening are open, wherein the opening/closing member comprises a first opening/closing portion configured to be arranged to close the first opening when the opening/closing member is at the closed position and a second opening/closing portion configured to close the second opening when the opening/closing member is at the closed position, said second opening/closing portion being movable relative to the first opening/closing portion; and a lock member configured to lock the second opening/closing portion with respect to the first opening/closing portion, wherein, in a case where the opening/closing member is at the open position, the lock member locks the second opening/closing portion at a protruding position at which the second opening/closing portion protrudes into a movement path through which the cartridge support member moves from the inner position to the outer position, and wherein, during a process of moving from the inner position to the outer position, the cartridge support member releases the lock by the lock member to thereby permit the second opening/closing portion to be moved to a retracted position at which the second opening/closing portion is retracted from the movement path.

2. An image forming apparatus according to claim 1, wherein the second opening/closing portion is configured such that it is resiliently biased toward a direction in which the second opening/closing portion moves from the retracted position to the protruding position.

3. An image forming apparatus according to claim 1, wherein the second opening/closing portion is rotatably mounted to the first opening/closing portion.

4. An image forming apparatus according to claim 1, wherein, during the process of moving to the outer position, the cartridge support member abuts the lock member to thereby release the lock by the lock member.

5. An image forming apparatus according to claim 1, wherein the second opening/closing portion comprises a guide portion configured to guide the movement of the cartridge support member at the retracted position.

6. An image forming apparatus according to claim 1, wherein when the second opening/closing portion is in the protruding position, the cartridge support member is further configured to take a second outer position where not all of the cartridges may be attached or detached outside the apparatus main body of the image forming apparatus.

7. An image forming apparatus according to claim 1, wherein the cartridge support member is further configured for attaching and detaching process cartridges as the plurality of cartridges thereto, said process cartridges each comprising a photosensitive drum and developing means configured to develop electrostatic latent image formed on the photosensitive drum.

8. An image forming apparatus according to claim 1, wherein the cartridge support member is provided with photosensitive drums, and is configured to allow attachment and detachment of the plurality of cartridges, said cartridges including developing means configured to develop electrostatic latent images formed on respective ones of the photosensitive drums.

9. An image forming apparatus according to claim 1, wherein the plurality of cartridges respectively each contain one of yellow, cyan, magenta, and black developer.

10. An image forming apparatus according to claim 1, wherein the second opening/closing portion at the retracted position is located downstream of the second opening/closing portion at the protruding position in a pull-out direction in which the cartridge support member moves from the inner position to the outer position.

* * * * *